US010302078B2

(12) United States Patent
Hiller

(10) Patent No.: US 10,302,078 B2
(45) Date of Patent: May 28, 2019

(54) MODIFIED BORES FOR A RECIPROCATING HIGH PRESSURE FLUID PUMP

(71) Applicant: Valtek Industries, Inc., Odessa, TX (US)

(72) Inventor: Victor Hiller, Odessa, TX (US)

(73) Assignee: Valtek Industries, Inc., Odessa, TX (US)

( * ) Notice: Subject to any disclaimer, the term of this patent is extended or adjusted under 35 U.S.C. 154(b) by 334 days.

(21) Appl. No.: 14/947,733

(22) Filed: Nov. 20, 2015

(65) Prior Publication Data

US 2017/0146011 A1 May 25, 2017

(51) Int. Cl.
*F04B 53/10* (2006.01)
*F04B 53/14* (2006.01)
*F04B 53/16* (2006.01)

(52) U.S. Cl.
CPC ..... *F04B 53/10* (2013.01); *F04B 53/14* (2013.01); *F04B 53/16* (2013.01)

(58) Field of Classification Search
CPC ..... F04B 53/006
See application file for complete search history.

(56) References Cited

U.S. PATENT DOCUMENTS 6,623,259 B1 * 9/2003 Blume ..... F04B 53/007 137/543.23
7,364,412 B2 * 4/2008 Kugelev ..... F04B 53/007 417/454
7,681,589 B2 * 3/2010 Schwegman ..... F16K 15/063 137/15.17
7,954,510 B2 6/2011 Schwegman
8,366,408 B2 2/2013 Wago et al.
8,662,864 B2 3/2014 Bayyouk et al.
8,707,853 B1 4/2014 Dille et al.
8,915,722 B1 12/2014 Blume
9,011,111 B2 4/2015 Lesko
2008/0282879 A1 * 11/2008 Arnold ..... F02M 59/44 92/169.1

(Continued)

OTHER PUBLICATIONS

MSI: Dixie Iron Works, Ltd.; Technical Manual for 1000 HP Quintuplex MSI QI-1000 Pump; Dated Feb. 21, 2014.
Weir SPM Oil & Gas; Well Service Pump Reference Guide; 2008.

*Primary Examiner* — Essama Omgba
*Assistant Examiner* — Timothy P Solak
(74) *Attorney, Agent, or Firm* — Polsinelli PC

(57) ABSTRACT

Fluid flow system including a block forming a first receiving portion having a first inner bore, a second receiving portion having a second inner bore, a third receiving portion having a third inner bore, and a fourth receiving portion having a fourth inner bore, all of which are in fluid communication with one another and form an intersecting portion. A reciprocatable piston is received in the first receiving portion. A first transition element is located between the first receiving and intersecting portions. A second transition element is located between the second receiving and intersecting portions. A third transition element is located between the third receiving and intersecting portions. A fourth transition element is located between the fourth receiving and intersecting portions. At least one transition element has transition bore truncated at opposing sides.

18 Claims, 10 Drawing Sheets

(56) References Cited

U.S. PATENT DOCUMENTS

| | | | | |
|---|---|---|---|---|
| 2010/0158726 | A1 | 6/2010 | Donald et al. | |
| 2010/0322802 | A1 | 12/2010 | Kugelev | |
| 2012/0288387 | A1 | 11/2012 | Freed et al. | |
| 2014/0083541 | A1 | 3/2014 | Raj et al. | |
| 2014/0086774 | A1* | 3/2014 | Chandrasekaran et al. | F04B 53/007 417/559 |
| 2014/0137963 | A1* | 5/2014 | Blume | F04B 53/10 137/565.23 |
| 2014/0356201 | A1 | 12/2014 | Blume | |

* cited by examiner

MODIFIED BORES FOR A RECIPROCATING HIGH PRESSURE FLUID PUMP

FIELD

The presently disclosed subject matter relates to fluid flow systems. More particularly, the presently disclosed subject matter relates to reciprocating plunger and piston-type pumps including those used in oil services.

BACKGROUND

Plunger pumps for the oilfield industry generally include a piston or plunger which is positioned in a piston or plunger bore, a suction valve which is positioned in a suction bore and a discharge valve which is positioned in a discharge bore. In operation, the piston or plunger is reciprocated in the corresponding bore to alternately draw fluid into the pump through the suction valve and then force the fluid out of the pump through the discharge valve.

BRIEF DESCRIPTION OF THE DRAWINGS

Implementations of the present technology will now be described, by way of example only, with reference to the attached figures, wherein:

FIG. 5A presents a first set of dimensions and FIG. 5B presents a second set of dimensions for clarity of illustration;

DETAILED DESCRIPTION

Figure 1:
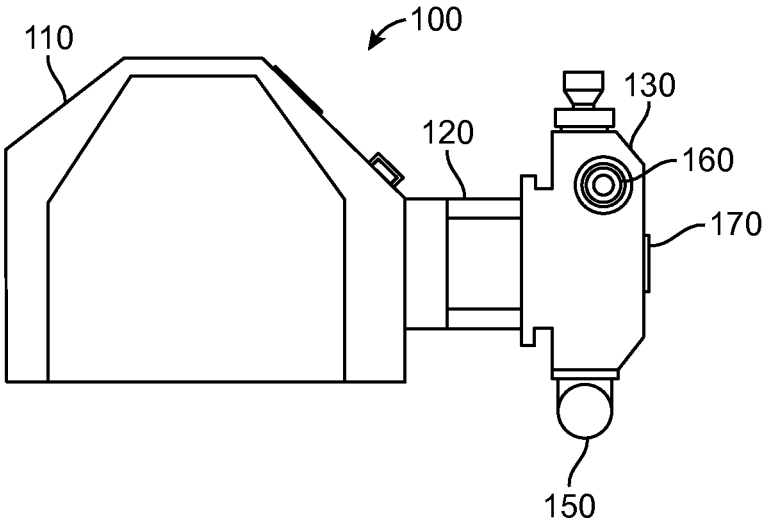
FIG. 1 is an elevational view of an exemplary reciprocating pump assembly according to certain embodiments of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The connections can be such that the objects are permanently connected or releasably connected. The term "outside" refers to a region that is beyond the outermost confines of a physical object. The term "axially" means substantially along a direction of the axis of the object. If not specified, the term axially is such that it refers to the longer axis of the object. The term "proximal" refers directionally to a close portion or end. In one example, proximal can refer to the point of connection or the closest end. The term "distal" refers directionally to a far portion or end. In one example, distal can refer to a terminal portion of a component. The terms "comprising," "including" and "having" are used interchangeably in this disclosure. The terms "comprising," "including" and "having" mean to include, but are not necessarily limited to, the things so described. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "about" means near, approximately, close to that position, number or range allowing for some standard deviation without departing therefrom.

The presently disclosed subject matter is directed to reciprocating plunger and piston-type pump systems. The systems comprise a fluid flow system having partial non-circular or truncated circular bores. Additionally, the present disclosure also concerns grooveless keepers. The present disclosure can be implemented with either the partial non-circular or truncated circular cross-sectional bore or the grooveless keeper. In other examples, including the illustrated example, both the non-circular or truncated circular cross-sectional bore and the grooveless keeper. The present disclosure allows systems produced with the partial non-circular bore to attain higher pounds per square inch (psi) ratings than fluid flow systems using circular bores. In a first aspect, the presently described subject matter can be directed to a fluid flow system configured to be coupled with a power system. The fluid flow system can include a block which forms a first receiving portion having a first inner bore diameter, a second receiving portion having a second inner bore diameter, a third receiving portion having a third inner bore diameter and a fourth receiving portion having a fourth inner bore diameter. The first receiving portion, second receiving portion, third receiving portion and fourth receiving portion can all be in fluid communication with one another and are configured to form an intersecting portion. The fluid flow system can further be configured to receive a piston in the first receiving portion, and the piston can be configured to reciprocate within the first receiving portion. A first transition element is located between the first receiving portion and the intersecting portion. A second transition element is located between the second receiving portion and the intersecting portion. A third transition element is located between the third receiving portion and the intersecting portion. A fourth transition element is located between the fourth receiving portion and the intersecting portion. Each of the first, second, third, and fourth transition elements have an outer diameter that is truncated on at two opposite sides for at least a portion of the circumference.

In a second aspect, the fluid flow system can include a keeper that partially extends across one of the first, second, third or fourth transition elements as described in the first aspect. The fluid flow system according to the second aspect can be implemented without the particular transition sections including the truncated portion. The keeper is configured to retain a valve located in the corresponding one of the first, second, third, or fourth receiving portion.

In a third aspect, the third receiving portion of the fluid flow system, according to the first or second aspect, is configured to receive a plug and an angle is formed between the respective inner bore and outer diameter.

In a fourth aspect, the second receiving portion of the fluid flow system, according to any one of first through the third aspects, is configured to receive a one way valve that is configured to allow fluid to exit from the intersecting portion upon being compressed by the piston.

In a fifth aspect, the fourth receiving portion of the fluid flow system, according to any one of the first through the fourth aspects, is configured to receive a one way valve that is configured to allow fluid to enter the intersection portion upon the piston being retracted.

In a sixth aspect, the one way valve of the fluid flow system, according to the fifth aspect, includes a keeper.

In a seventh aspect, the third receiving portion of the fluid flow system, according to the sixth aspect, is configured to receive a plug that is configured to receive and retain a portion of the keeper.

In an eighth aspect, the keeper of the fluid flow system, according to the sixth aspect, includes a retainer tab that is configured to extend into the intersection portion and further extend into the third receiving portion.

In a ninth aspect, the keeper of the fluid flow system, according to the sixth aspect, includes two ears that extend outward from the intersection portion and a retainer tab that extends inward toward the intersection portion, such that one of the two ears and the retainer tab are both located on a side of the keeper.

In a tenth aspect, the presently described subject matter is directed to a keeper. The keeper includes an elongate member having a center. The keeper can also include a protrusion extending from about the center of the elongate member in a first direction. Additionally, the keeper can include a pair of ears extending in the first direction. Each of the pair of ears extending from opposite ends of the elongate member. Furthermore, the keeper can include a retainer tab that extends from the elongate member in a second direction that is substantially opposite to the first direction. The retainer tab configured to extend beyond one of the pair of ears in a direction parallel to the elongate member.

In an eleventh aspect, the retainer tab of the keeper, according to the tenth aspect, has an upper surface that is substantially parallel to an upper surface of the elongate member.

In a twelfth aspect, the retainer tab of the keeper, according to the eleventh aspect, has an end configured to be received by a plug of the fluid flow system to retain the keeper.

In a thirteenth aspect, the retainer tab and one of the pair of ears of the keeper, according to the twelfth aspect, form a receiving space therebetween.

In a fourteenth aspect, a distal end of the protrusion and pair of ears of the keeper, according to the tenth through the thirteenth aspects, are substantially flush with one another.

In a fifteenth aspect, the protrusion of the keeper, according to the tenth through the fourteenth aspects, is substantially cylindrical.

In a sixteenth aspect, the pairs of ears of the keeper, according to the tenth through the fifteenth aspects, extend at an angle relative to the elongate member.

In a seventeenth aspect, a first portion and second portion of the retainer tab of the keeper, according to the tenth through the sixteenth aspects, extend at a first angle and second angle relative to the elongate member, respectively.

In an eighteenth aspect, the second angle of the second portion, according to the seventeenth aspect, is about zero.

In a nineteenth aspect, the presently disclosed subject matter can be directed to a fluid flow system configured to be coupled to a power system. The fluid flow system can include a block. The block can form a first receiving portion, a second receiving portion, a third receiving portion, and a fourth receiving portion. The first receiving portion can have a first inner bore diameter. The second receiving portion can have a second inner bore diameter. The third receiving portion can have a third inner bore diameter. The fourth receiving portion can have a fourth inner bore diameter. The first receiving portion, the second receiving portion, the third receiving portion, and fourth receiving portion can in fluid communication with one another and are configured to form an intersecting portion. A first transition element is located between the first receiving portion and the intersecting portion. A second transition element is located between the second receiving portion and the intersecting portion. A third transition element is located between the third receiving portion and the intersecting portion. A fourth transition element is located between the fourth receiving portion and the intersecting portion. The fluid flow system further includes a keeper having a retainer tab that extends partially into the third receiving portion. At least one of the first, second, third, and fourth transition elements have an outer circumference that is truncated at two opposite sides for at least a portion of the circumference and an angle is formed between the respective inner bore and outer circumference.

In a twentieth aspect, the third receiving portion of the fluid flow system, according to the twentieth aspect, is configured to receive a plug that is configured to receive and retain a portion of the retainer tab.

FIG. 1 is an elevational view of an exemplary reciprocating pump assembly 100. The reciprocating pump assembly 100 includes a crankshaft housing 110. A piston or plunger rod housing 120 attaches to a side of crankshaft housing 110 and extends to a block 130. In other examples, the housing can be omitted and the reciprocating pump assembly 100 can be coupled to the crankshaft housing 110 by a plurality of rods. In other embodiment, the crankshaft housing 110 can also be omitted and the engine that is underneath can be coupled to the reciprocating pump assembly 100 by a plurality of rods. The block 130 typically includes a fluid inlet 150 and a fluid outlet 160. The fluid inlet 150 can be coupled to a reservoir or series of tanks. The tanks can contain different material as well for example, water, mud, proppant, sand or any desired material that can be pumped. The fluid outlet 160 can be coupled to a well bore.

Figure 2:
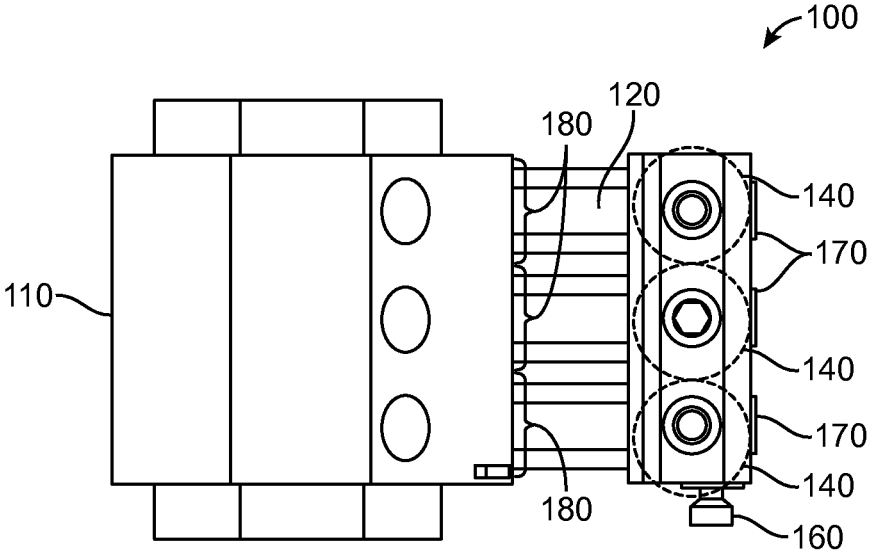
FIG. 2 is a top plan view of the reciprocating pump assembly of FIG. 1 according to certain embodiments of the present disclosure.

FIG. 2 is a top plan view of the reciprocating pump assembly. The block 130 comprises a series of cylinders 140. The pump 100 comprises three cylinders 140 to yield a triplex pump. In alternative embodiments, the block 130 can comprise a single cylinder 140 to yield a singlex pump, two cylinders 140 to yield a duplex pump, or five cylinders 140 to yield a quintuplex pump. In some embodiments, the cylinders 140 can be formed singularly in a block that are then coupled one to another in a frame. In one embodiment, each cylinder 140 includes a fluid inlet 150 and a fluid outlet 160. A suction retainer cover 170 couples with an end of each cylinder 140 opposite the plunger rod housing 120. The plunger rod housing 120 further comprises three piston or plunger throws 180. Each plunger throw 180 houses a piston or plunger rod (not shown) extending into a corresponding cylinder 140. Each plunger throw 180 extends in the same longitudinal direction from the crankshaft housing 110. The crankshaft housing 110 houses a crankshaft (not shown) which is typically connected to a motor (not shown). The motor rotates the crankshaft in order to drive the pump 100. As is readily appreciable by those skilled in the art, alternating the cycles of pumping fluid from each of cylinders 140 helps minimize the primary, secondary, and tertiary forces associated with reciprocating pump 100.

Figure 3:
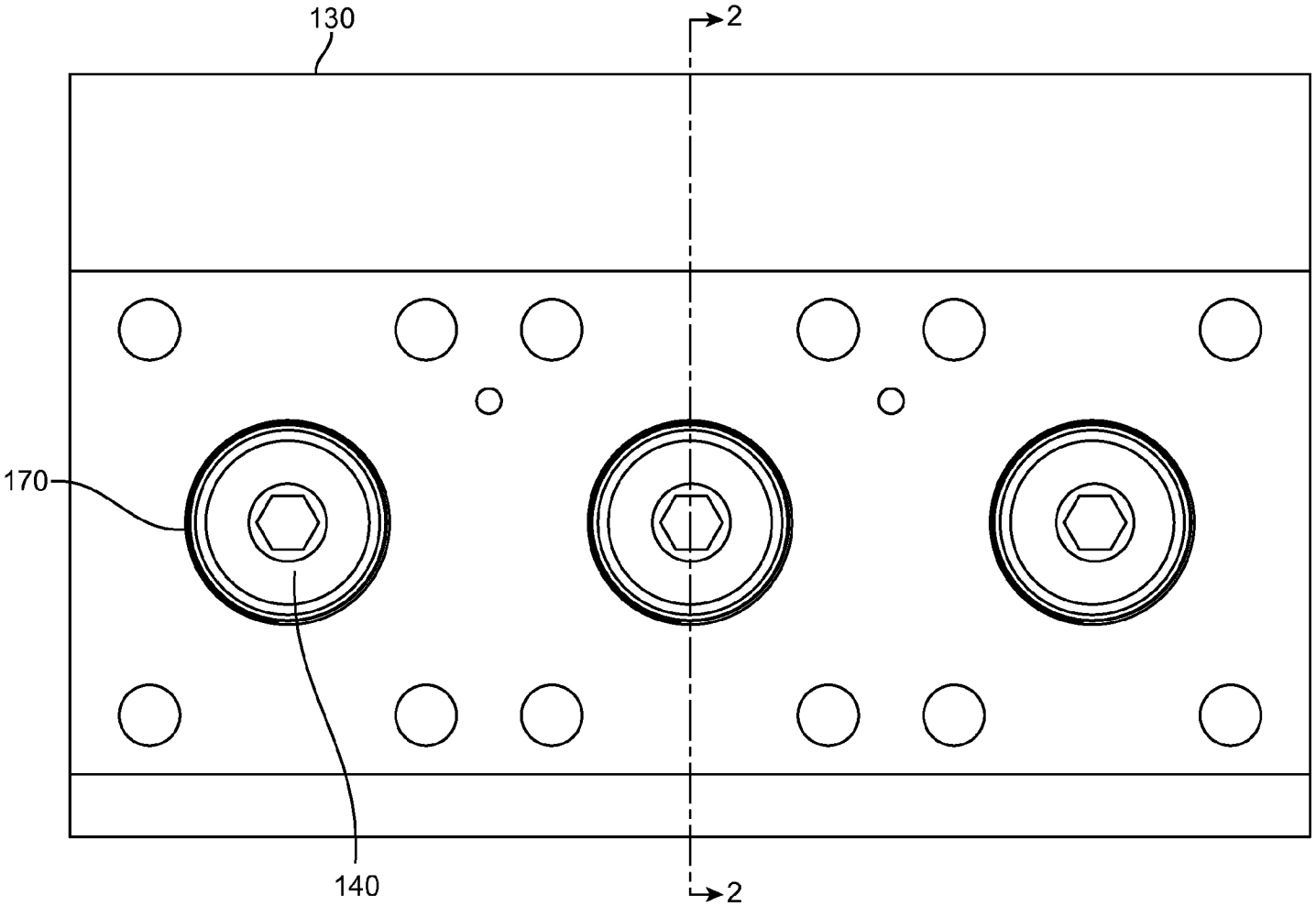
FIG. 3 is a side plan view of a cylinder block of a reciprocating pump assembly according to certain embodiments of the present disclosure.

FIG. 3 is a side plan view of the block 130 of the reciprocating pump assembly of FIG. 1 having three cylinders 140 and three suction valve retainer covers 170. As shown, the suction valve retainer covers 170, and corresponding cylinders 140, are spaced apart equally in the block 130. In other implementations, the spacing can be varied. While three cylinders 140 are illustrated, the present embodiment can be implemented with any number of cylinders 140 as indicated above.

Figure 4:
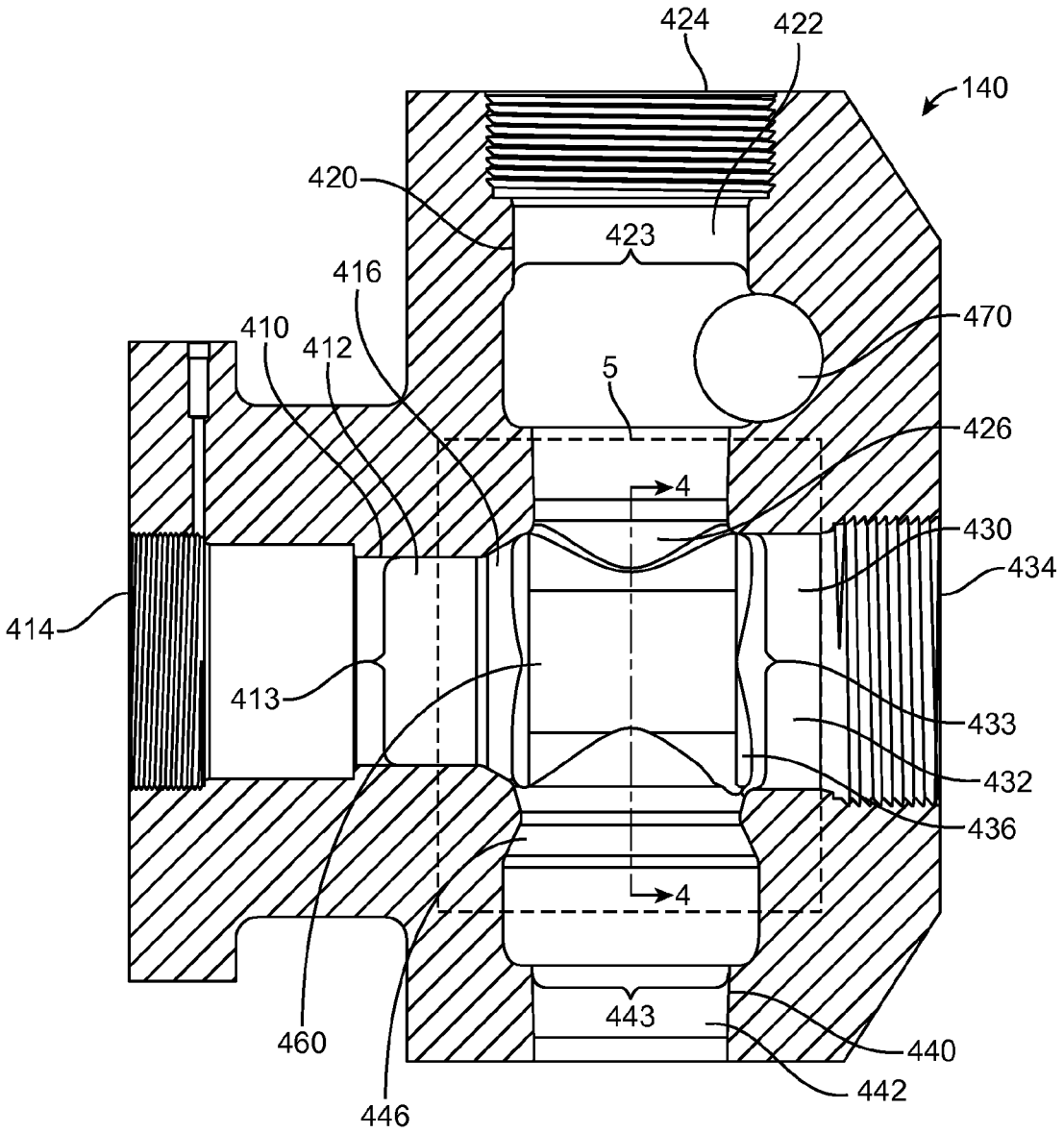
FIG. 4 is a cross-sectional view of the cylinder block taken along line 2-2 of FIG. 3 according to certain embodiments of the present disclosure.

FIG. 4 is a cross-sectional view of a cylinder block 140 taken along line 2-2 of FIG. 3. The cylinder block 140 forms a first receiving portion 410 having a first inner bore 412, a second receiving portion 420 having a second inner bore 422, a third receiving portion 430 having a third inner bore 432, and a fourth receiving portion 440 having a fourth inner bore 442, all of which are in fluid communication with one another and are configured to form an intersecting portion 460. The bores 412, 422, 432 of the first receiving portion 410, the second receiving portion 420, and the third receiving portion 430 have threaded sections 414, 424, 434 respectively. Each of the bores 412, 422, 432, 442 has a corresponding diameter 413, 423, 433, 443. The diameters 413, 423, 433, 443 of the bores 412, 422, 432, 442 can be the same or different and can be tailored to the requirements of the fluid to be pumped or contents thereof, or user needs. A first transition element 416 is located between the first receiving portion 410 and the intersecting portion 460. A second transition element 426 located between the second receiving portion 420 and the intersecting portion 460. A third transition element 436 is located between the third receiving portion 430 and the intersecting portion 460. A fourth transition element 446 is located between the fourth receiving portion 440 and the intersecting portion 460. The cylinder block 140 also includes a discharge port 470 for the outflow of fluid from the intersecting portion 460.

Figure 5A:
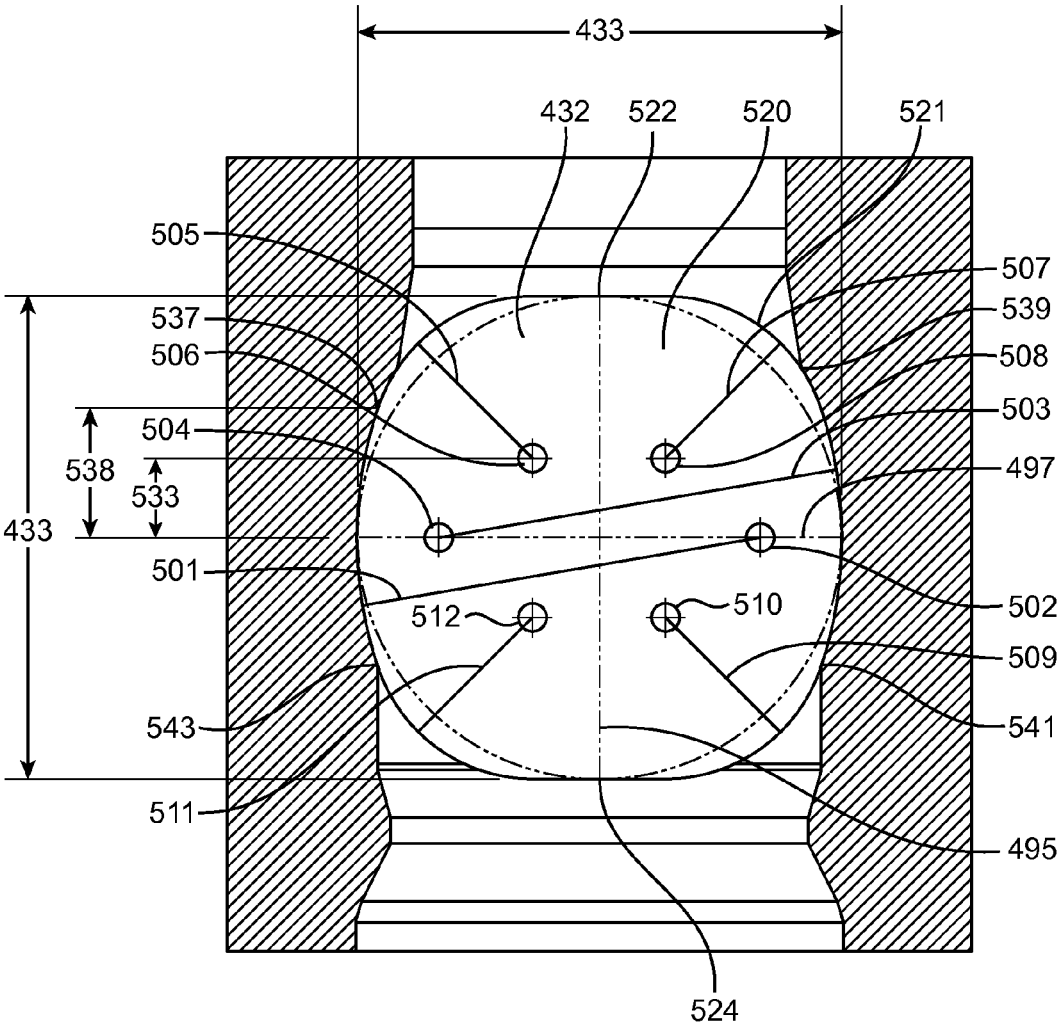
FIGS. 5A-B are a cross-sectional of a portion of the cylinder block taken along line 4-4 of FIG. 4 according to certain embodiments of the present disclosure, where

FIG. 5A is a cross-sectional of a portion of the cylinder block 140 corresponding to the section line 4-4 of FIG. 4. More specifically, FIG. 5A shows a cross-section of a portion of the cylinder block 140 showing the inner bore 432 and a transition bore 520 of the third receiving portion 430. As illustrated, the inner bore 432 has a substantially circular inner diameter 433 having at a vertical center line 495 and a horizontal center line 497 respectively. The transition bore 520 is truncated at two opposite sides (522, 524). Additionally, the remainder of a perimeter 521 of the transition bore 520 is formed by a series of radiuses that join together with the two opposite sides (522, 524).

The first radius 501 can be defined as being five-sixths (5/6) of the diameter 433 of the inner bore 432. The first radius 501 has a first radius center point 502. The first radius center point 502 is located at five-sixths (5/6) of the diameter 433 from the nine o'clock position on the horizontal center line 497. Proceeding in a clockwise fashion, the arc formed by the first radius 501 adjoins the arc formed by a second radius 505 that has a center point 506. The second radius 505 is one third (1/3) of the inner diameter 433. The arc of the second radius 505 forms the perimeter from the contact with the arc of the first radius 501 until the second radius 505 touches the truncated opposite side 522.

The arc formed by the third radius 507 extends from the truncated opposite side 522. The third radius 507 is one third (1/3) of the inner diameter 433. The third radius 507 is measured from the third center point 508. The arc of the third radius 507 forms the perimeter until it contacts with the arc formed by the fourth radius 503. The fourth radius 503 is five-sixths (5/6) of the inner diameter 433. The fourth radius 503 is measured from the fourth center point 504. The arc formed by the fifth radius 509 extends from contract with the arc of the fourth radius 503 to the truncated opposite side 524. The fifth radius 509 is one third (1/3) of the inner diameter 433. The fifth radius 509 is measured from the fifth center point 510. The arc formed by the sixth radius 511 extends from the truncated opposite side 524 to contact with the arc of the first radius 501. The sixth radius 511 is one third (1/3) of the inner diameter 433. The sixth radius 511 is measured from the sixth center point 512.

Figure 5B:
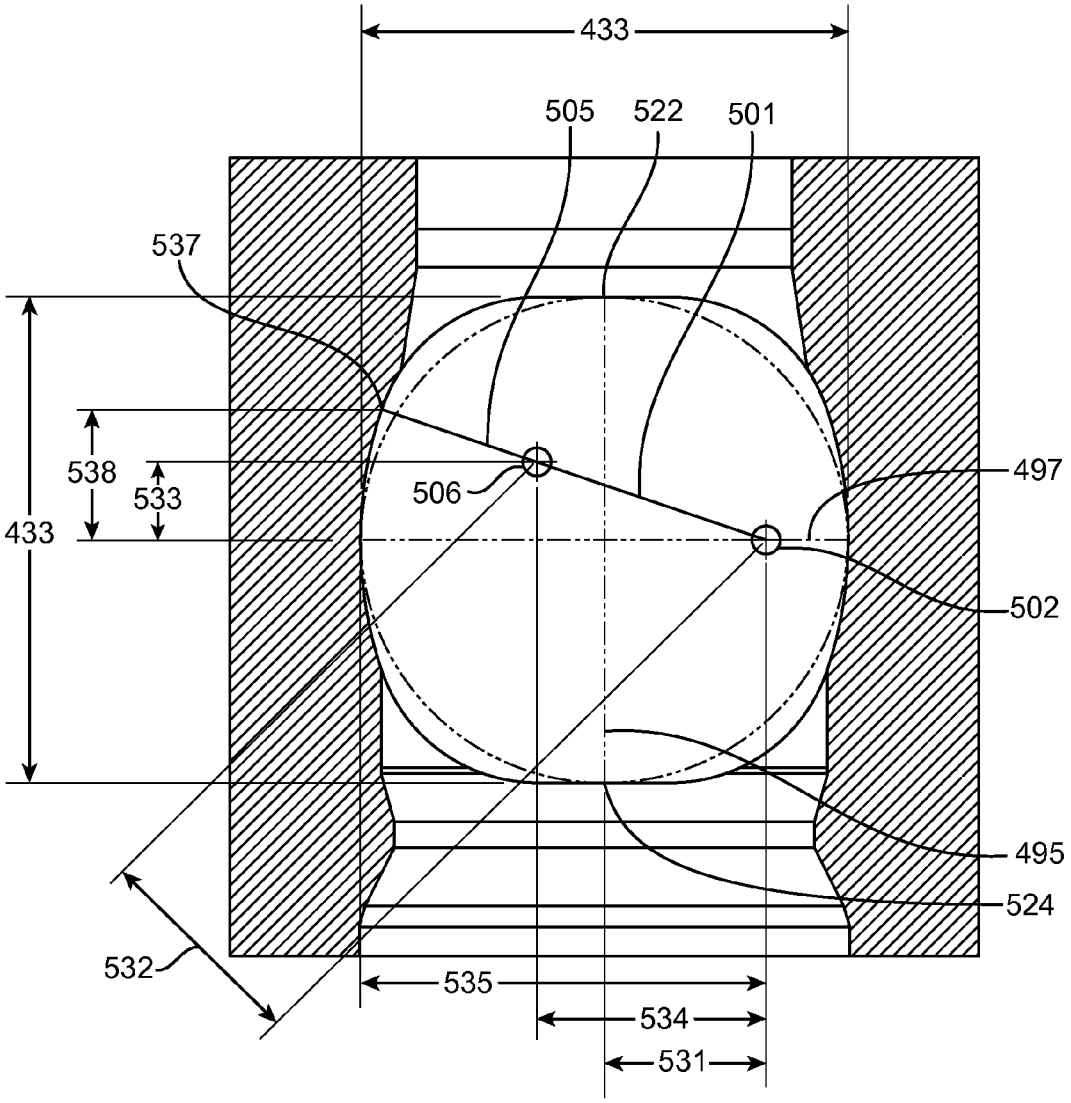

The above described center points can be determined from the relationship presented below. FIG. 5B illustrates the first center point 502 and the second center point 506. As stated earlier, the first center point 502 is located on the horizontal center line 497. The second center point 506 is the point from which the second radius 505 extends from to create a portion of the perimeter. The distance 532 between the first center point 502 and the second center point 506 is equal to the first radius 501, which is five sixth (5/6) of the inner diameter 433, minus the second radius 505, which is one third (1/3) of the inner diameter 433. In equation format, the above calculation can be written as G=B-D, where G is the distance 532, B is the first radius 501, and D is the second radius 505. Therefore, in the above example distance 532 is equal to one half (1/2) of the inner diameter 433.

The second center point 506 is vertical from the horizontal center line 497 by a distance 533 equal to one half (1/2) the inner diameter 433 minus the second radius 505, which is one third (1/3) the inner diameter 433. In an equation format, the relationship can be described as E=F−D, where the distance 533 above the horizontal center line 497 is E, one half (1/2) the inner diameter 433 is F, and the second radius 505 is D. Therefore, in the above example the distance 533 is equal to one sixth (1/6) of the inner diameter 433. Furthermore, the point at which the second radius 505 contacts the truncated opposite side 522 at a point that is vertical from the second center point 506 by a distance equal to the second radius 505.

The first center point 502 and the second center point 506 are separated along the horizontal centerline 497 by a distance 534, which is equal to the square root of two divided by three $$\left(\frac{\sqrt{2}}{3}\right)$$

of the inner diameter 433. In equation format, the above calculation can be written as $H=\sqrt{(G^2-E^2)}$, where H is the distance 534, G is distance 532, and E is distance 533. Alternatively, the above calculation can be written as H=(cos(arcsin(E/G)))*G, where H is the distance 534, G is distance 532, and E is distance 533.

The first center point 502 and a first transition point 537 are separated along the horizontal centerline 497 by a distance 535, which is equal to the five ninths multiplied by the square root of two $$\left(\frac{5\sqrt{2}}{9}\right)$$

of the inner diameter 433. In equation format, the above calculation can be written as $K=\sqrt{(B^2-J^2)}$, where K is the distance 535, J is distance 538 defined by the relationship $$B*\left(\frac{E}{G}\right),$$

and B is distance 501. Alternatively, the above calculation can be written as K=(cos(arcsin(J/B)))*B. The first transition point 537 is defined by as the point where the arc of the first radius 501 is tangent to the arc of the second radius 505.

The truncated opposite side 522, 524 can have a length equal to the square root of two divided by three $$\left(\frac{\sqrt{2}}{3}\right)$$

minus one third (⅓) of the inner diameter 433, multiplied by two. In equation format, the above calculation can be written as I=2(H−D), where I is the length of the truncated opposite sides 522, 524, H is distance 534, and D is second radius 505.

While the illustration of FIG. 5B only provides for the location of the first center point 502 and the second center point 506, the other center points can be calculated in a similar fashion. Alternatively in reference to FIG. 5A, the third center point 508 is a mirror image of the second center point 506 across the vertical centerline 495. Second transition point 539 is a mirror image of transition point 537 across the vertical centerline 495 and formed at the intersection of the third radius 507 and the fourth radius 503. The fifth center point 510 is a mirror image of the third center point 508 across the horizontal centerline 497. Third transition point 541 is a mirror image of third transition point 539 across the horizontal centerline 497 and formed at the intersection of the fifth radius 509 and the fourth radius 503. The sixth center point 512 is a mirror image of the fifth center point 510 across the vertical centerline 495. Fourth transition point 543 is a mirror image of the third transition point 541 across the vertical centerline 495 and formed at the intersection of the first radius 501 and the sixth radius 501. Truncated opposite side 524 is a mirror image of truncated opposite side 522 across the horizontal centerline 497.

While FIGS. 5A-5B illustrate a cross-section of the inner bore 432 of the third receiving portion 430, any one or all of the first, second third, and fourth receiving portions 410, 420, 430, 440 and corresponding inner bores 412, 422, 432, 442 can exhibit the form described in relation to FIGS. 5A-5B.

Figure 6:
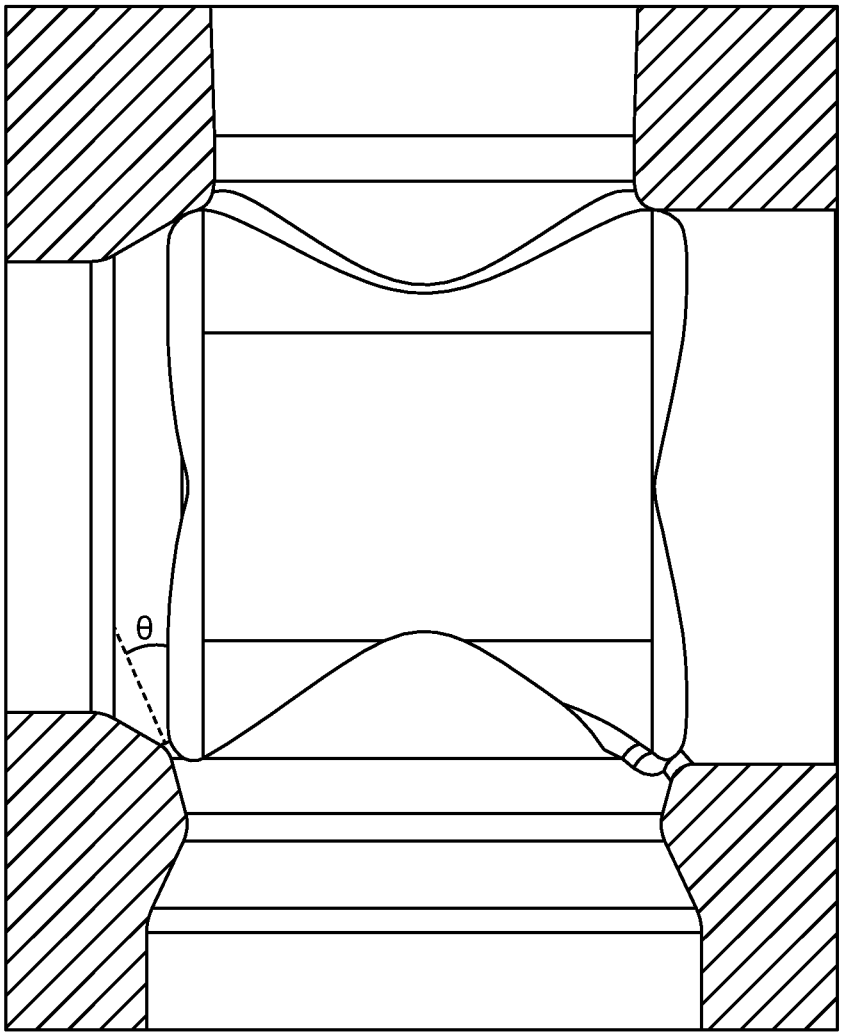
FIG. 6 is a cross-sectional view of a portion of the cylinder block corresponding to the boxed section 5 of FIG. 4 according to certain embodiments of the present disclosure.

FIG. 6 is a cross-sectional view of a portion of the cylinder block according to the boxed section 5 of FIG. 4. An angle (θ) is formed between the inner bore 412 and the transition bore 416. Any or all of the inner bores 412, 422, 432, 442 and corresponding outer circumferences can exhibit the angle described in FIG. 6. In at least one embodiment of the present disclosure, the angle (θ) is 15 degrees (°). Alternatively the angle (θ) can be any angle ranging from 1° to 30°, alternatively 5° to 25°, and alternatively 10° to 20°. In at least one embodiment, the angle (θ) can be configured to provide for clearance of a portion of the keeper depending on the location in which the angle (θ) is measured.

Figure 7A:
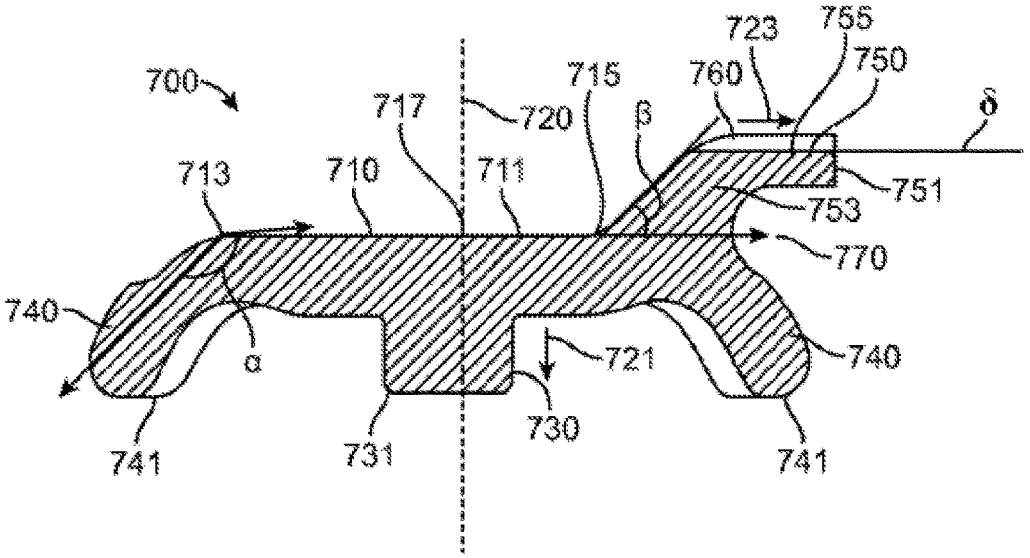
FIG. 7A is a cross-sectional view of an exemplary keeper according to certain embodiments of the present disclosure.
Figure 7B:
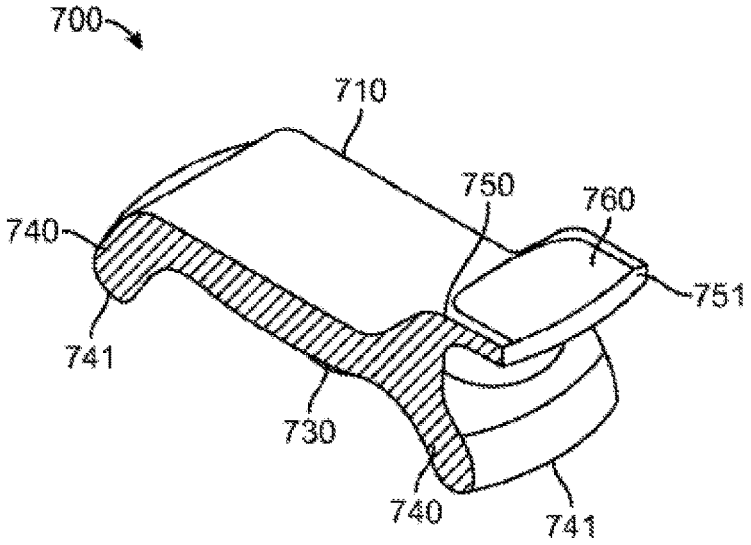
FIG. 7B is an isometric view the keeper of FIG. 7A according to certain embodiments of the present disclosure.
Figure 11:
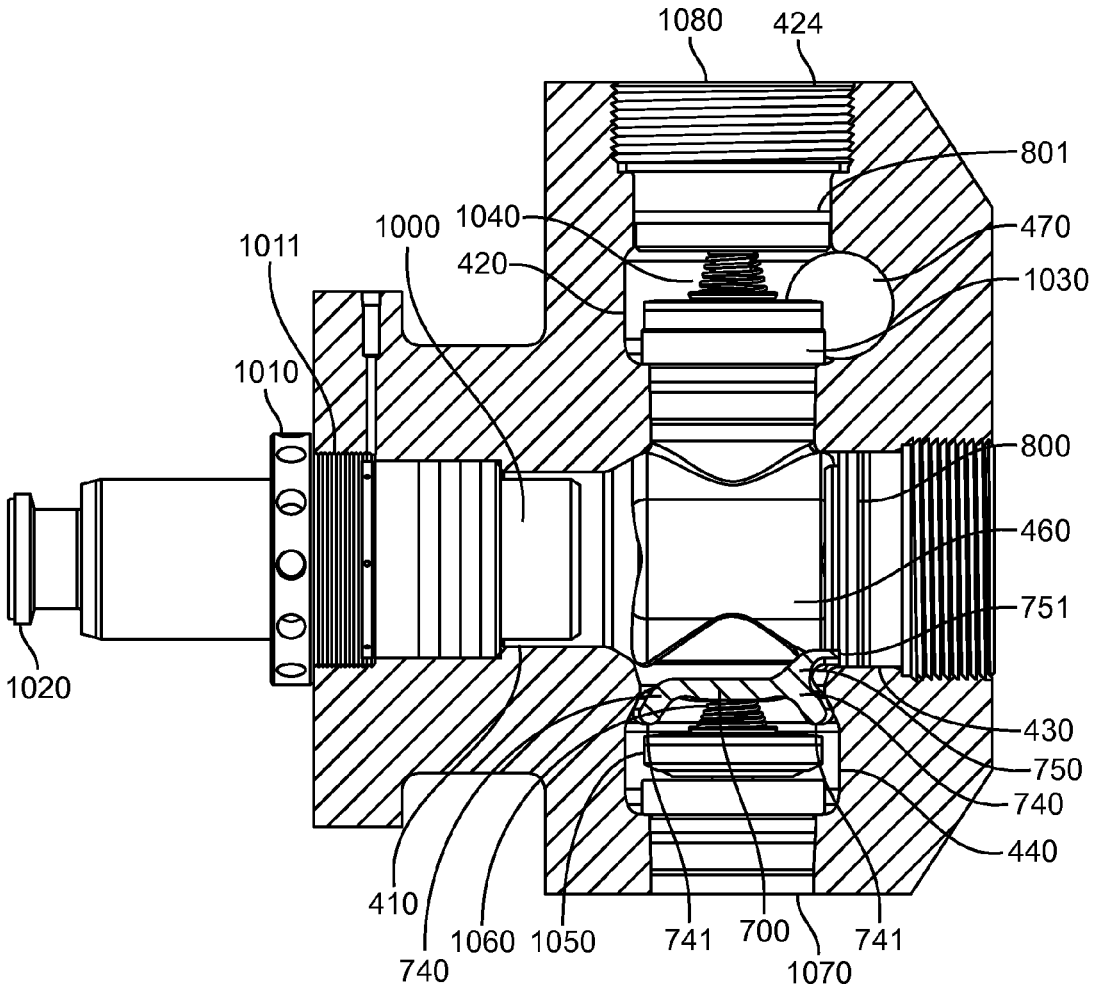
FIG. 11 is cross-sectional view similar to FIG. 4 and including the piston, valves and plug, according to certain embodiments of the present disclosure.

FIGS. 7A and 7B are side plan cross-sectional and isometric views, respectively, of an exemplary keeper of a valve stop assembly (See FIG. 11). The keeper 700 comprises a main elongate body 710 having center line 720. The center line 720 can be based on the main elongate body 710. Additionally, the keeper 700 can comprise a protrusion 730 extending from about the center 717 of the elongate member 710 in a first direction 721. The first direction can be a direction that is parallel to the center line 710, which can be perpendicular to the upper surface 711 of the elongate member 711.

Furthermore, the keeper 700 can comprise a pair of ears 740 extending in the first direction 721. Each of the pair of ears 740 can extend from opposite ends 713, 715 of the elongate member 710. The pair of ears 740 can also extend at an angle relative to the first direction 721 as illustrated. The angle relative to the first direction can be designed to accommodate a structure formed within the block for example the corresponding transition element, which has been referred to as the fourth transition element in the present example. While the above center line 720 has been described in relation to the elongate main body 710, the center line 720 can be based on the spacing between the pair of ears 740.

The keeper 700 can include a retainer tab 750 that extends from the elongate member 710 in a second direction 723 that is substantially perpendicular to the first direction 721. The protrusion 730 can be substantially cylindrical. In alternative embodiments, the protrusion 730 can be square, pentagonal, hexagonal, octagonal, or any other polygonal shape. Furthermore, as shown in FIG. 7A, the protrusion 730 is grooveless. The retainer tab 750 is configured to extend beyond an adjacent one of the pair of ears 740 in a second direction 723 parallel to the elongate member 710. The retainer tab 750 can have an upper surface 760 that is substantially parallel to an upper surface of the elongate member 710. The retainer tab 750 can have a distal end 751 that is configured to be received by a structure. The distal end 751 can be received by a plug as will be described below. The retainer tab 750 and the adjacent one of the pair of ears 740 form a receiving space 770 therebetween.

The protrusion 730 and each of the pair of ears 740 have distal ends 731, 741 which are substantially flush with each other. Thus, a parallel line can be formed that insects the distal end 731 of the protrusion 730 and distal ends 741 of the pair of ears as compared to the upper surface 711 of the elongate member 710. In alternative embodiments, each of the pair of ears 740 have distal ends 741 which are substantially flush with each other and the protrusion 730 has a distal end 731 which is not substantially flush with the distal ends 741 of the pair of ears 740. That is, the protrusion 730 can have a distal end which extends beyond a plane touching the distal ends of the pair of ears 730 or does not extend beyond a plane touching the distal ends of the pair of ears 730. In other embodiments, the distal ends 741 of each of the respective one of the pair of ears 740 can have a different length.

As shown in FIG. 7A, each of the pair of ears 740 extend at an angle $\alpha$ relative to the elongate member 710. The angle $\alpha$ can be based upon the shape of the transition portion as described above. Additionally, a first portion 753 of the retainer tab 750 can extend at a first angle $\beta$ relative to the elongate member 710. A second portion 755 of the retainer tab 750 can extend at a second angle $\delta$ relative to the elongate member 710. As illustrated the second angle $\delta$ is zero.

The keeper 700 can be formed from a variety of different materials for use in a pump assembly. For example, the keeper 700 can be made of a material that is a metal such as aluminum, copper, magnesium, tungsten, or titanium, a metal alloy or composite such as steel, brass, tungsten or titanium nitride or carbide, a ceramic such as aluminum oxynitride or silicon carbide, or a plastic such a polycarbonates, polyacrylics, polyurethanes, or polyvinyl chlorides. The material of the keeper 700 can be dependent upon the type of fluid and/or material that pump is designed to handle. The keeper 700 can be formed from a block of the material (metal, metal alloy or composite, ceramic, or plastic) using, for example a lathe and/or milling device or any other fabrication device known to one of ordinary skill in the art. Alternatively, the keeper 700 can be formed using other formation processes. The keeper 700 can be formed using a 3-D printer or a mold. Additionally, the keeper 700 can be formed using a combination, for example using a mold and milling operation.

Figure 9:
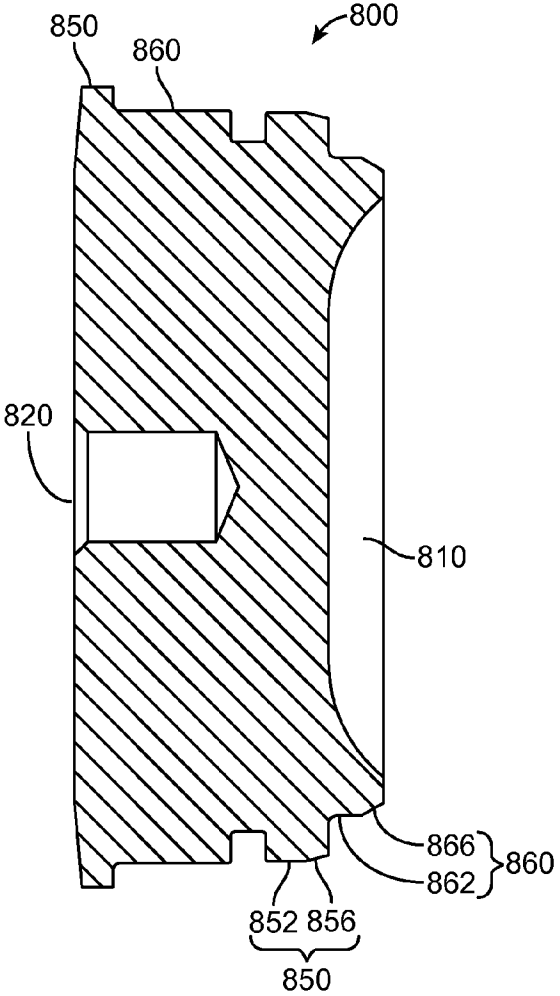
FIG. 9 is a side plan cross-sectional view of the plug of FIG. 8, shown from another perspective, according to certain embodiments of the present disclosure.
Figure 8:
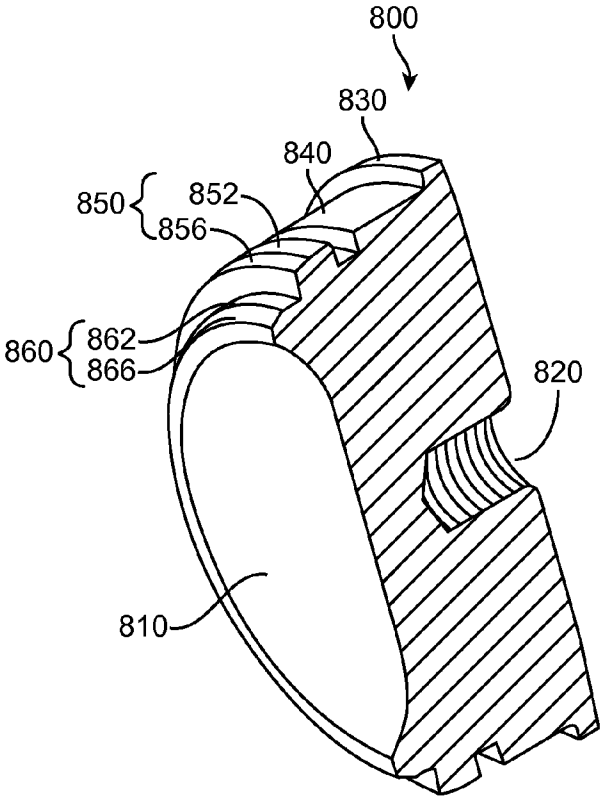
FIG. 8 is an isometric cross-sectional view of an exemplary suction valve plug according to certain embodiments of the present disclosure.

FIGS. 8 and 9 are an isometric and side plan cross-sectional views of suction valve plug 800. As illustrated in FIGS. 8-9, plug 800 comprises a recessed portion 810 and an insert 820. In one example, when the plug is installed in the third receiving portion 430 of a cylinder block 140, the recessed portion 810 will face the intersection portion 460. The installation in the third receiving portion 430 is only exemplary and other implementations are possible depending on the positioning of the keeper. In other embodiments, no plug 800 is required as the corresponding portion can be formed in the block itself. When implemented with a plug 800, the system can be easier to access for cleaning, repair, or other servicing. Additionally, the plug 800 can enable an easier construction and assembly of the system.

The insert 820 is configured to receive a tool (not shown), which is configured to engage the plug 800 to facilitate insertion and removal of the plug 800. Additionally, the plug 800 can be held in place by a retainer cover 170 (see FIG. 10). The plug 800 seals the third receiving portion 430 with a seal (not shown) that is mounted in a recess that circumscribes an exterior of the plug 800.

Plug 800 is retained in the third receiving portion 430 by the retainer cover 170, which threadedly engages the threaded section 434 of the third receiving portion 430 (FIG. 11). The plug 800 further comprises a first circumferential surface 830, a second circumferential surface 840, a third circumferential surface 850, and a fourth circumferential surface 860. The third circumferential surface 850 comprises a substantially flat portion 852 and a tapered portion 856. The fourth circumferential surface 860 comprises a substantially flat portion 862 and a tapered portion 866. Another plug 801 can also be used to seal the second receiving portion 420. The another plug 801 is configured to simply provide a sealing surface for the second receiving portion 420. Additionally a retainer cover 170 can be implemented to hold the another plug 801 in place. The retainer cover 170 can threadedly engage the second receiving portion 420 via threaded engagement of the of the retainer cover 170 with the threaded section 424. The another plug 801 can differ from the plug 800 in that no additional surfaces are provided for retaining the keeper.

Figure 10:
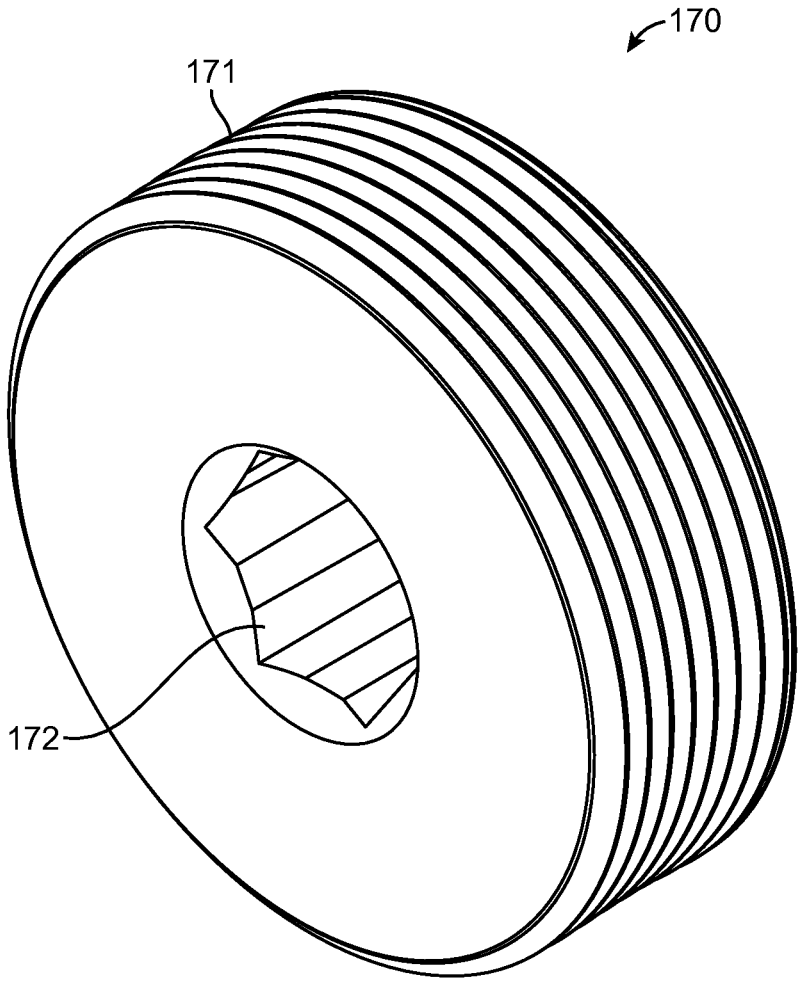
FIG. 10 is an isometric view of an exemplary retainer cover.

FIG. 10 is an isometric view of an exemplary retainer cover. As shown, the retainer cover 170 comprises a threaded circumference 171 configured to threadedly engage the threaded portion of the third receiving portion 430. The retainer cover 170 further comprises a hex head driver receiving socket 172 to receive a hex head driver. Rotation of the retainer cover using a hex head driver results in threaded engagement of the retainer cover 170 with threaded sections 424, 434 of the second receiving portion 420 and the third receiving portion 430 respectively.

FIG. 11 is a cross-sectional view similar to FIG. 4 and including the piston 1000, valves 1030, 1050 and plug 800. As illustrated, the cylinder block comprises the first receiving portion 410, the second receiving portion 420, the third receiving portion 430, and the fourth receiving portion 440. A plunger or piston 1000 is received in the first receiving portion 410. A threaded male ring 1010, having a diameter larger than the piston 1000, surrounds a portion of the piston 1000 and threadedly engages the female threaded portion 1011 of the first receiving portion 410.

A coupling 1020 is illustrated that couples the piston 1000 with the crankshaft via the plunger throw 180 (See FIGS. 1 and 2). While a coupling 1020 is illustrated, the piston 1000 can be coupled to the driving engine or driving source.

The second receiving portion 420 houses an outlet valve 1030 which is coupled with a first valve spring 1040. The third receiving portion 430 is plugged with plug 800 and the plug 800 is retained in the third receiving portion 430 using the retainer cover 170 (not shown in FIG. 11). The fourth receiving portion 440 houses an inlet valve 1050. The keeper 700 is coupled with the inlet valve 1050 via a second valve spring 1060. Fluid enters the intersecting point 460 through the fourth receiving portion 440 via an inlet 1070. Fluid exits the intersecting point 460 through the second receiving portion 420 via the discharge port 470. An outlet 1080 of the second receiving portion 420 includes threaded section 424. The second receiving portion 420 is also plugged with plug 800 and the plug 800 is retained in the second receiving portion 420 using the retainer cover 170 (not shown in FIG. 11).

In at least one alternative embodiment, the second receiving portion 420 is not plugged with plug 800. When the second receiving portion 420 is not plugged with the another plug 801, a gauge or reservoir, having a male threaded end for example, can be coupled with the third receiving portion 420 via the threaded section 424.

The protrusion 730 (See FIG. 7) of the keeper 700 extends in the direction of the second valve spring 1060. The protrusion 730 is obscured by the second valve spring 1060 in FIG. 10. The retainer tab 750 can be receiving in a cavity defined by the third receiving portion 430, the third circumferential surface 850 of the plug 800, and the fourth circumferential surface 860 of the plug 800 (see also, FIGS. 8-9). The retainer tab 750 extends partially into the intersection portion 460 and the distal end 751 of the retainer tab 750 is configured to be received by the plug 800 as described herein. While the valves 1030, 1050 have been described in relation to springs, the valves 1030, 1050 can be implemented with other biasing members as well.

In one embodiment, a gear (not shown) contained within the crankshaft housing 110 is mechanically connected to crankshaft (not shown) and is rotated by the motor through one or more gears (not shown). A connector rod (not shown) connects to a crosshead (not shown) through a crosshead pin (not shown) which holds the connector rod longitudinally relative to the crosshead. Connector rod pivots about crosshead pin as crankshaft rotates with the other end of connector rod. A piston rod (not shown) extends from crosshead in a longitudinally opposite direction from crankshaft. The connector rod and the crosshead convert rotational movement of crankshaft into longitudinal movement of the piston rod.

The piston 1000 is connected to the piston rod for pumping the fluid passing through the cylinder block 140. The cylinder block 140 connects to the end of plunger rod housing 120 extending away from crankshaft housing 110 (FIGS. 1 and 2). The piston 1000 compresses the fluid being pumped by reciprocating pump assembly 100.

The piston 1000 reciprocates, or moves longitudinally toward and away from cylinder block 140, as the crankshaft rotates. As the piston 1000 moves longitudinally away from the intersection point 460, the pressure of the fluid inside the intersection point 460 decreases creating a differential pressure across the inlet valve 1050, which actuates the valve 1050 and allows the fluid to enter the intersection point 460 from the fluid inlet 1070. The fluid being pumped enters the intersection point 460 as the piston 1000 continues to move longitudinally away from the intersection point 460 until the pressure difference between the fluid inside the intersection point 460 and the fluid in the fluid inlet 1070 is small enough for the inlet valve 1050 to actuate to its closed position. As piston 1000 begins to move longitudinally towards the intersection point 460, the pressure on the fluid inside of the intersection point 460 begins to increase. Fluid pressure inside the intersection point 460 continues to increase as piston 1000 approaches the intersection point 460 until the differential pressure across the outlet valve 1030 is large enough to actuate the valve 1030 and allow the fluid to exit the intersection point 460 through the fluid outlet 1080 or the discharge port 470.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A fluid flow system configured to be coupled with a power system, the fluid flow system comprising:

a block forming a first receiving portion having a first inner bore diameter, a second receiving portion having a second inner bore diameter, a third receiving portion having a third inner bore diameter and a fourth receiving portion having a fourth inner bore diameter, all of which are in fluid communication with one another and are configured to form an intersecting portion;

a piston configured to be received in the first receiving portion and configured to reciprocate within the first receiving portion;

a first transition element located between the first receiving portion and the intersecting portion;

a second transition element located between the second receiving portion and the intersecting portion;

a third transition element located between the third receiving portion and the intersecting portion;

a fourth transition element located between the fourth receiving portion and the intersecting portion;

wherein each of the first, second, third, and fourth transition elements have a transition bore that is truncated at two opposite sides for at least a portion of a circumference, wherein the circumference of at least one of the first, second, third, and fourth transition bores is formed by at least four radii that join together with the two opposite sides.

2. The fluid flow system as recited in claim 1, further comprising a keeper that partially extends across one of the first, second, third or fourth transition elements and configured to retain a valve located in the corresponding one of the first, second, third, or fourth receiving portion.

3. The fluid flow system as recited in claim 1, wherein the third receiving portion is configured to receive a plug and an angle is formed between the respective inner bore and transition bore.

4. The fluid flow system as recited in claim 1, wherein the second receiving portion is configured to receive a one way valve that is configured to allow fluid to exit from the intersecting portion upon being compressed by the piston.

5. The fluid flow system as recited in claim 1, wherein the fourth receiving portion is configured to receive a one way valve that is configured to allow fluid to enter the intersection portion upon the piston being retracted.

6. The fluid flow system as recited in claim 5, wherein the one way valve comprises a keeper.

7. The fluid flow system as recited in claim 6, wherein the third receiving portion is configured to receive a plug that is configured to receive and retain a portion of the keeper.

8. The fluid flow system as recited in claim 6, wherein the keeper includes a retainer tab that is configured to extend into the intersection portion and further extend into the third receiving portion.

9. The fluid flow system as recited in claim 6, wherein the keeper comprises two ears that extend outward from the intersection portion and a retainer tab that extends inward toward the intersection portion, such that one of the two ears and the retainer tab are both located on a side of the keeper.

10. The fluid flow system as recited in claim 1, wherein the four radii are less than a half of the respective first, second, third, or fourth inner bore diameter.

11. The fluid flow system as recited in claim 1, wherein the at least one transition bore is formed by six radii.

12. The fluid flow system as recited in claim 11, wherein four radii are equal to about one-third the diameter of the respective inner bore and two radii are equal to about five-sixths of the diameter of the respective inner bore.

13. The fluid flow system of claim 12, wherein each of the five-sixth radii form opposing arc lengths between adjacent radii equal to about one-third the diameter of the respective inner bore.

14. The fluid flow system of claim 12, wherein a perimeter of at least one transition bore is formed by six arc lengths and the two opposing truncated sides.

15. The fluid flow system of claim 1, wherein the two opposing truncated sides of the at least one truncated bore are formed between adjacent radii equal to about one-third the diameter of the respective inner bore.

16. The fluid flow system of claim 1, wherein each of the first, second, third, and fourth transition bores are formed by at least four radii, each radii being less than a half of the respective inner bore diameter.

17. A fluid flow system configured to be coupled to a power system, the fluid flow system comprising:

a block forming a first receiving portion having a first inner bore diameter, a second receiving portion having a second inner bore diameter, a third receiving portion having a third inner bore diameter and a fourth receiving portion having a fourth inner bore diameter, all of which are in fluid communication with one another and are configured to form an intersecting portion;

a first transition element located between the first receiving portion and the intersecting portion;

a second transition element located between the second receiving portion and the intersecting portion;

a third transition element located between the third receiving portion and the intersecting portion;

a fourth transition element located between the fourth receiving portion and the intersecting portion;

a keeper comprising a retainer tab that extends partially into the third receiving portion;

wherein each of the first, second, third, and fourth transition elements have a transition bore that is truncated at two opposite sides for at least a portion of a circumference, wherein the circumference of at least one of the first, second, third, and fourth transition bores is formed by at least four radii that join together with the two opposite sides.

18. The fluid flow system as recited in claim 17, wherein the third receiving portion is configured to receive a plug that is configured to receive and retain a portion of the retainer tab.

* * * * *